US005778834A

United States Patent [19]

Piccinini

[11] Patent Number: 5,778,834

[45] Date of Patent: Jul. 14, 1998

[54] OPPOSED RECIPROCATING PISTON INTERNAL COMBUSTION ENGINE

[76] Inventor: Giuseppe Raoul Piccinini, Via Strada Nuova per Isorella, Gottolengo (Brescia), Italy

[21] Appl. No.: 766,678

[22] Filed: Dec. 13, 1996

[30] Foreign Application Priority Data

Dec. 13, 1995 [IT] Italy ..... MI95A2608

[51] Int. Cl.[6] ..... F02B 33/10

[52] U.S. Cl. ..... 123/55.2; 123/71 R

[58] Field of Search ..... 123/55.2, 55.5, 123/55.7, 71 R

[56] References Cited

U.S. PATENT DOCUMENTS

| | | | |
|---|---|---|---|
| 860,123 | 7/1907 | Boudreaux et al. | 123/55.2 |
| 877,294 | 1/1908 | Chase et al. | 123/55.5 |
| 2,310,733 | 2/1943 | Duke | 123/55.2 |
| 3,329,134 | 7/1967 | Llewellyn | 123/55.7 |
| 4,138,972 | 2/1979 | Wilson | 123/71 R |
| 4,516,539 | 5/1985 | Andreen | 123/71 R |
| 5,158,046 | 10/1992 | Rucker . | |
| 5,448,972 | 9/1995 | Paut . | |

FOREIGN PATENT DOCUMENTS

| | | |
|---|---|---|
| 341.150 | 6/1904 | France . |
| 1253448 | 1/1961 | France . |
| 2067.119 | 8/1971 | France . |
| 3415550 | 11/1985 | Germany . |

*Primary Examiner*—Marguerite McMahon
*Attorney, Agent, or Firm*—IP Group of Pillsbury Madison & Sutro LLP

[57] ABSTRACT

In order to reduce the overall dimensions and the weight of a motion transmission system including piston, a tie-rod and a crankshaft, the crankshaft and a single tie-rod are arranged inside two mutually opposite pistons which constitute one single monolithic element reciprocating inside two mutually opposite cylinder. The machine can operate as an endothermic motor with atmospheric feed, as a self-supercharged endothermic motor, as a hydraulic motor, or as a self-driven compressor, or as a compressor which can be driven by an externally applied motor.

3 Claims, 4 Drawing Sheets

OPPOSED RECIPROCATING PISTON INTERNAL COMBUSTION ENGINE

BACKGROUND OF THE INVENTION

The present invention relates to an opposed reciprocating piston internal combustion engine.

Such reciprocating machines, commonly defined "boxers" are mainly used as motor means for motor vehicles mainly because (due to the pistons being arranged on opposite sides relative to the crankshaft), while operating they generate much less vibration than other reciprocating machines, in which the cylinders, and consequently the pistons, are arranged according to different patterns then those of boxers.

Unfortunately, the main drawback of boxer engines is of having large general dimensions (defined as "transversal dimensions"). Further drawbacks (also in this case mainly of vibrational character) derive from the fact that the cylinders, and consequently the pistons, on opposite sides, are slightly offset in order to allow the respective tie-rods to be linked to the crankshaft.

From European patent application EP-A-0 503 842 an engine of boxer type is known which does not display those further drawbacks because the mutually opposite cylinders, and consequently their pistons, are all arranged on a same axis. Unfortunately, this arrangement causes an increase in the reciprocating masses, because three tie-rods are provided for each pair of mutually opposite pistons.

Unfortunately, the overall transversal dimensions remain substantially equal to those of more traditional boxer engines, and, therefore, rather large.

From patent application EP-A-0 628 709 a boxer engine is known with coaxial cylinders, which displays reduced overall transversal dimensions because the pair of mutually opposite pistons constitute one single monolithic element reciprocating inside two mutually opposite cylinders. The monolithic element is hinged onto a first crankshaft arranged between the pistons.

The first crankshaft transversely extends through the monolithic element and is then rotatably and supported out-of-center relative to a second crankshaft, which can be linked to the residual parts of the engine and on which the flywheel is initially keyed. Both drawbacks deriving from cylinders offsetting and the large general dimensions are hence avoided but, as in EP-A-0 503 842, these reults are obtained at the cost of a considerable increase in reciprocating masses (two crankshafts instead of one single crankshaft).

SUMMARY OF THE INVENTION

The purpose of the present invention is of providing a reciprocating machine of boxer engine type which offers the advantages offered by the machines disclosed in the above-cited documents, without displaying the disadvantages thereof.

In other terms, the purpose of the present invention is of providing a reciprocating machine of the type comprising at least one pair of mutually opposite pistons (boxer) which simultaneously has:

its cylinders arranged coaxially, limited overall transversal dimensions, reciprocating masses of limited dimension, i.e., smaller than those of more traditional boxer engines with the same power.

Besides being novel, the invention is inventive, because by constraining the monolithic element to the crankshaft through one single traditional tie-rod arranged inside the monolithic element, also the desired light weight is obtained, which practically consists in constraining two pistons by means of one single tie-rod. It should be furthermore observed that the machine is sturdy and is also cheap because (except for pistons) the residual elements have all the same structure that the same elements of a corresponding, more traditional boxer engine, would have.

The inventive step can also be deduced from the matter of fact that the dimensioning of the engine, the study of the construction cycle and of the assembly cycle, and the realization of the conveyer for the machine according to the present invention do not pose any particular problems, because they can be carried out by using well known and widely used means and technologies.

The machine according to the present invention can operate, and consequently be used, as an endothermic engine with atmospheric pressure feed, or as an self-supercharged endothermic engine, or as a hydraulic motor, or as a self-driven compressor, or as a compressor driven by an externally applied motor means.

BRIEF DESCRIPTION OF THE DRAWINGS

The invention is illustrated for merely exemplifying, non-limitative purposes in the form of an endothermic engine, by means of the attached drawings, in which.

DETAILED DESCRIPTION

Figure 1:
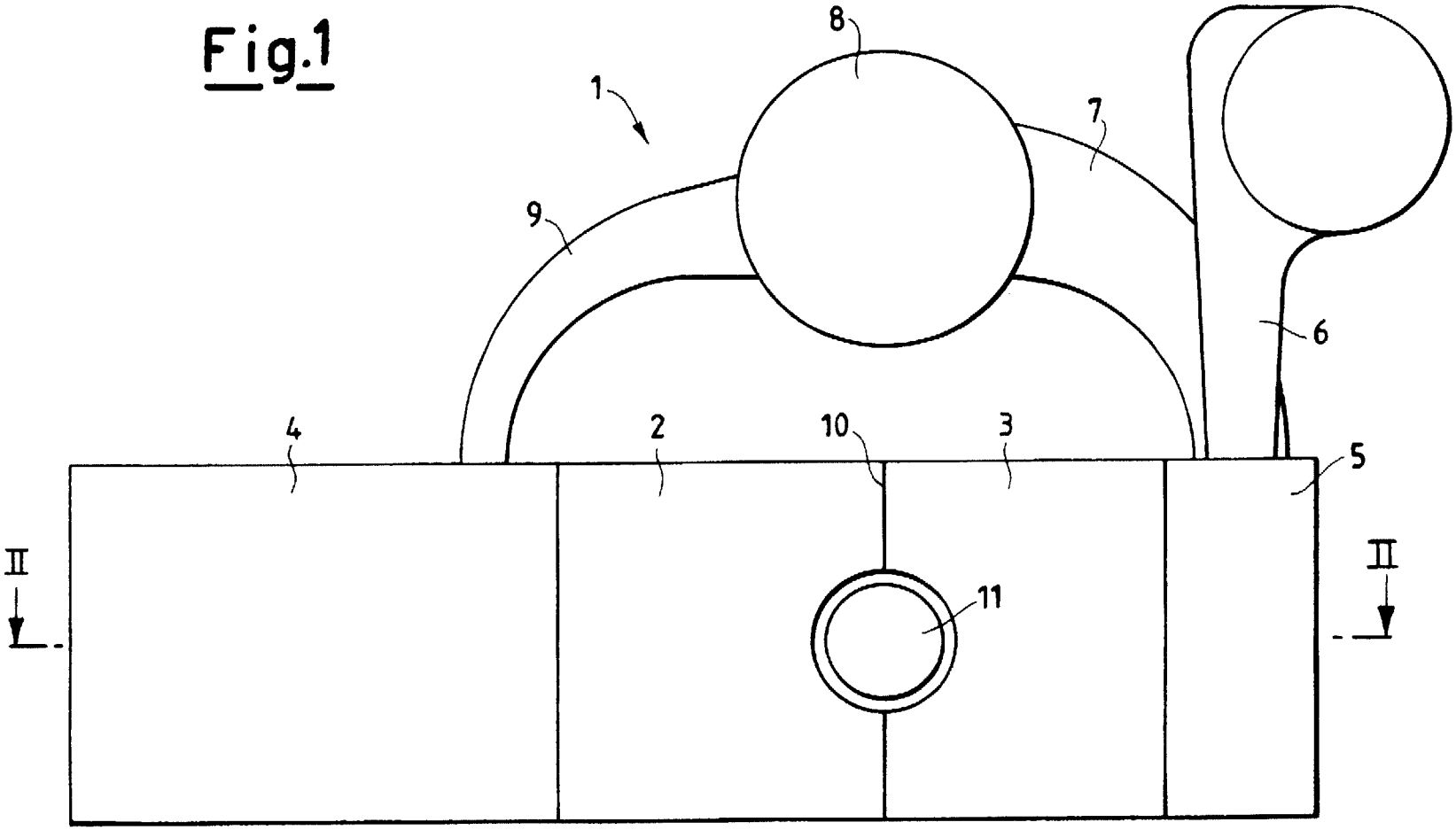
FIG. 1 is a schematic elevation view of an engine according to the present invention, of the type with two combustion chambers and self-supercharged, i.e., by means of an incorporated compressor with two compression chambers.
Figure 2:
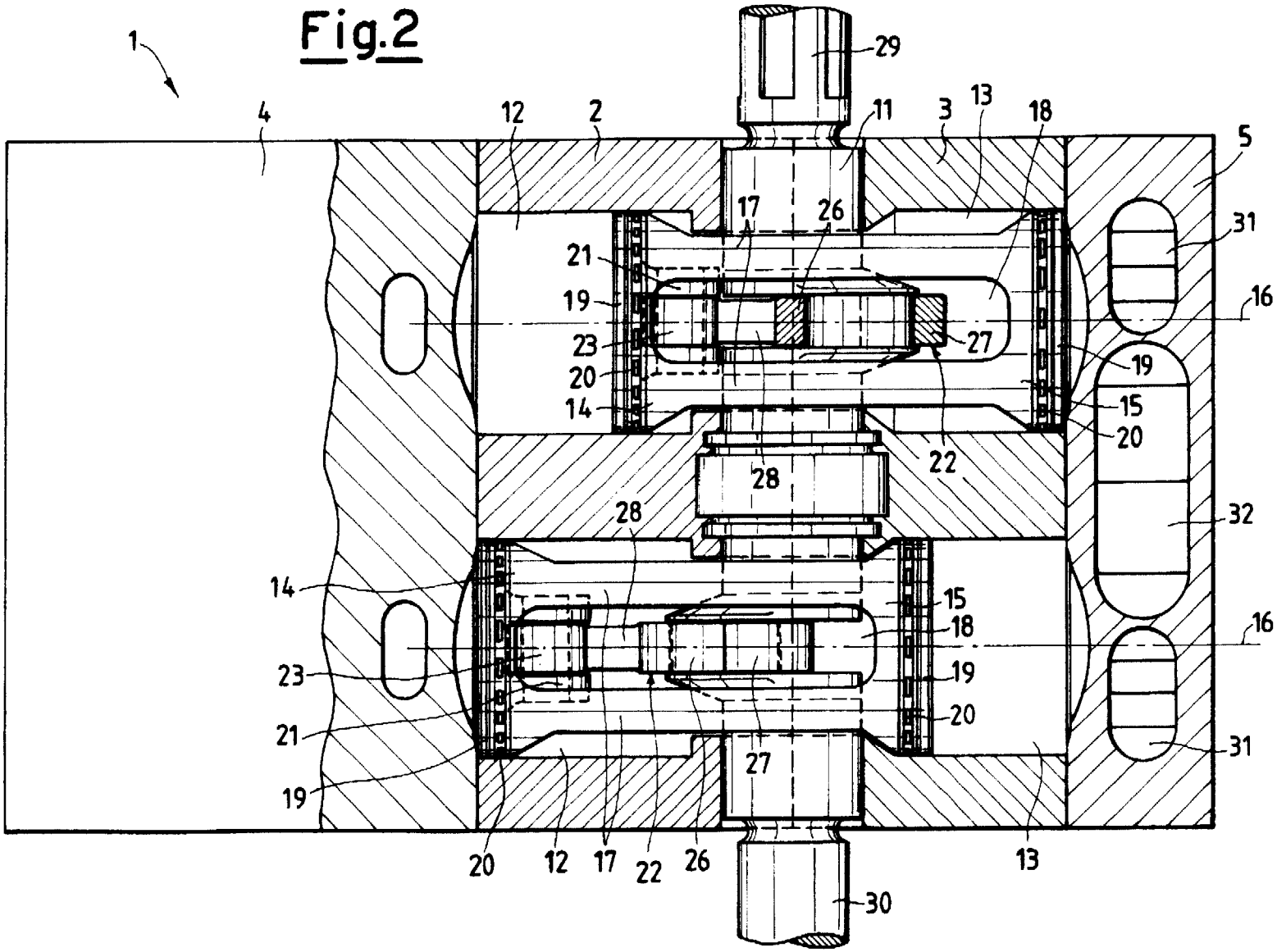
FIG. 2 is a schematic sectional view on the section line II—II of FIG. 1.
Figure 3:
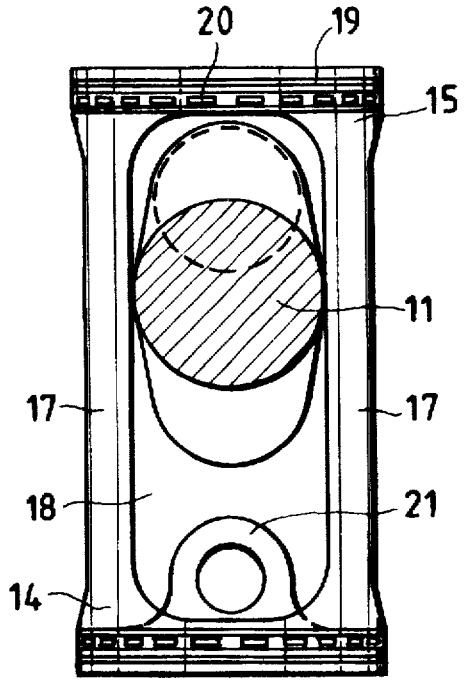
FIGS. 3–7 schematically show the steps of assembly of the pistons, tie-rod and crankshaft of the engine of the present invention
Figure 4:
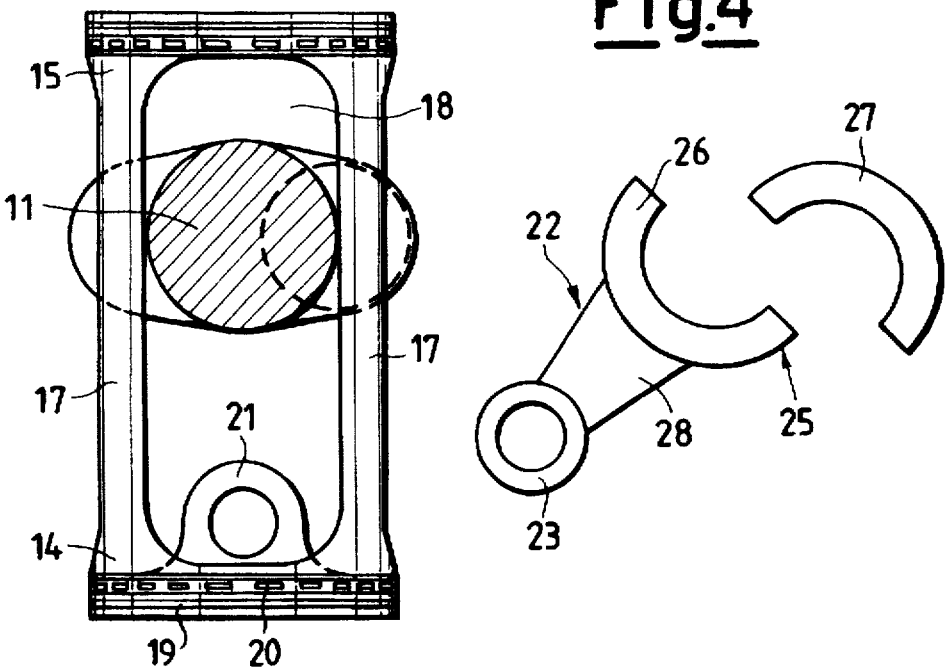
Figure 5:
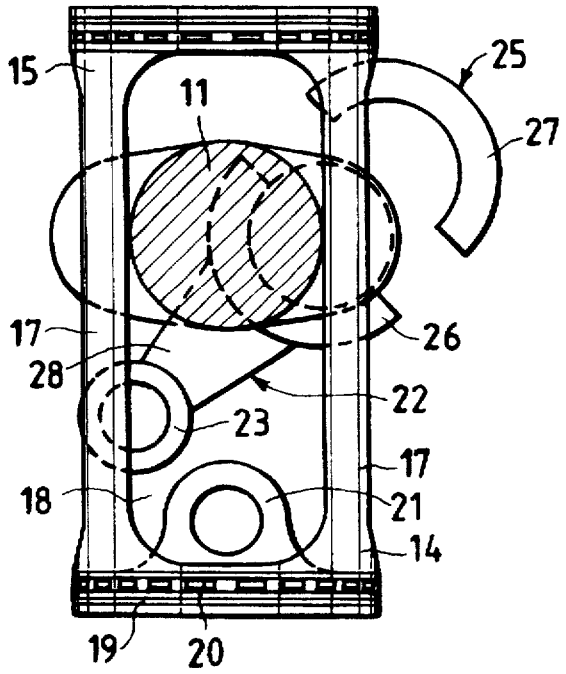
Figure 6:
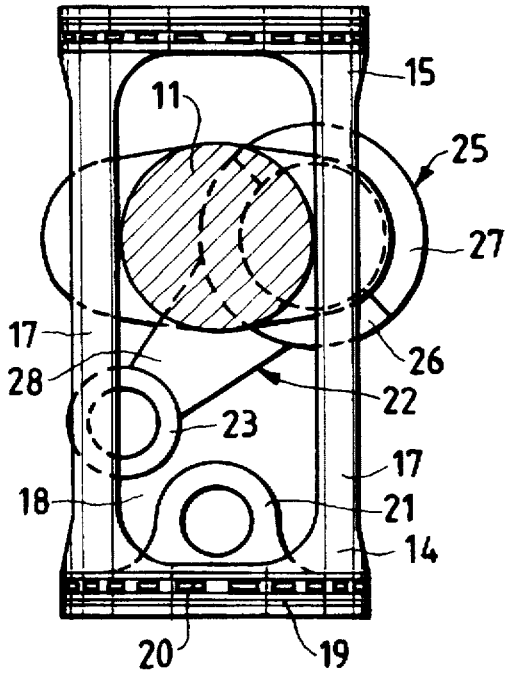
Figure 7:
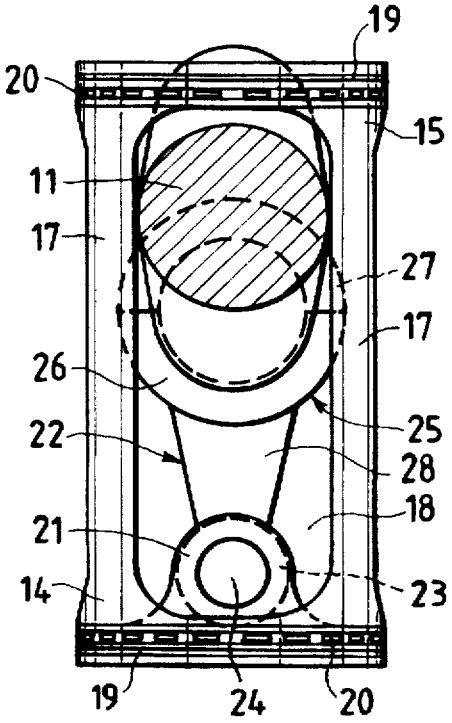

Referring to the above-mentioned drawing figures, the machine according to the present invention, generally indicated with by the numeral (1), is an endothermic engine. It essentially comprises a first shell (2) and a second shell (3), a motor head (4), a pumping head (5), a first duct (6) for atmospheric air intake, a second duct (7) for compressed air, a pressure accumulator (8) and a third duct (9) for compressed air.

The first shell and the second shell are substantially specularly identical and are connected along a plane represented by line (10) on which the crankshaft (11) lies. The first shell (2) bears the motor cylinders (12) inside which the motor pistons (14) reciprocate and the second shell (3) bears the pumping cylinders (13) inside which the pumping pistons (15) reciprocate.

Each motor piston (14) is joined to the opposite and coaxial (relative to axis (16)) pumping piston (15) yielding a monolithic element (14–15). The monolithic element comprises two mutually opposite uprights (17) which, between them, define the gaps (18) through which the crankshaft (11) extends. The pistons (14) and (15) are provided with at least one compression ring (19) and one scraper ring (20), but are substantially without skirt, because each piston acts as the guide means for the other piston it is connected to.

At the crown of one of the mutually opposite pistons, in the herein exemplified case the motor piston, bores (21) are provided in order to allow a tie-rod (22) to be linked to the monolithic element (14–15) to which the piston (14) provided with bores (21) belongs. The tie-rod (22) is linked to the monolithic element (14–15) by means of a gudgeon pin (24) extending through its foot (23). The tie-rod (22) is fastened to the crankshaft (11) at its head (25) which comprises a first half-shell (26) and a second half-shell (27). The first half-shell (26) constitutes an enbloc piece with the stem (28) of the tie-rod (22). The crankshaft comprises a first grooved end (29) to which a clutch-transmission unit (not illustrated) can be linked, and a second end (30) with which auxiliary engine organs (pumps, A.C. generator, and so forth, not illustrated) are connected.

The motor head (4) is conventional in construction and therefore it is not illustrated in detail. It can be, e.g., of the type with a plurality of valves per each cylinder (e.g., two discharge valves and two intake valves), and provided with two camshafts. The pumping head (5) comprises intake valves (31) and one single nonreturn valve (32). In order to reduce the overall dimensions and increase the reliability, in the herein exemplified case, the valves (31) and (32) are of the blade type and therefore functioning owing to the effect of difference in pressures acting on their closing surfaces.

During engine operation, the pumping pistons (15) feed pressurized air to the accumulator (8), for use for supporting the combustion inside the combustion chambers defined by the motor pistons (14) into which fuel is injected by means of an injection system, not illustrated. The illustrated engine is super-charged by itself ("self-supercharged").

From the above, description those skilled in the art will learn not to limit the use of the machine according to the present invention to the sector of endothermic engines because of what is stated hereinabove as to the technical problem, to its solution and to the derived advantages can essentially be applied also to the following further machines, not discussed herein for the sake of brevity: an endothermic engine with atmospheric pressure feed, a self-fed supercharged endothermic engine (the hereinabove discussed case), or and apparatus fed from an external system, a hydraulic motor, a self-driven compressor, and a compressor driven by an externally applied motor means.

I claim:

1. An opposed reciprocating piston internal combustion engine, comprising:

at least one pair of mutually opposed pistons arranged to reciprocate as one single monolithic element respectively in a respective two mutually opposed cylinders;

a crankshaft arranged between the pistons of each said pair, said crankshaft extending through a gap in each said monolithic element, between mutually opposite uprights which are integrally formed with the pistons of each respective said pair; said crankshaft having a rotation axis;

each said monolithic element being hinged to said crankshaft by a respective single tie-rod, each said tie-rod being arranged within a respective said monolithic element, and having a head hinged to said crankshaft and a foot hinged to one said piston of each said pair, at a crown of the respective said piston;

said cylinders, pistons, crankshaft and each said tie-rod being housed in a housing which is divided into a plurality of pieces, including two shells which are divided along a plane which contains said rotation axis of said crankshaft; said housing providing support for said crankshaft near two opposite ends of said crankshaft and at at least one intermediate site between said two opposite ends; and said engine being arranged to operate as one of an Otto-cycle engine and a diesel engine.

2. The engine of claim 1, wherein:

for each said monolithic element, one piston of the respective pair is a motor piston and the other is a compressor piston arranged for compressing combustion air being supplied to the respective said motor piston.

3. The engine of claim 1, wherein:

each tie-rod comprises a head which is disassemblably assembled from two half-shells, and a monolithic foot connecting with one of said two-half-shells, and constrained to a respective piston of each said pair, by a respective gugeon pin.

* * * * *